US005384390A

United States Patent [19]

Schobesberger et al.

[11] Patent Number: 5,384,390

[45] Date of Patent: Jan. 24, 1995

[54] FLAME-RETARDANT, HIGH TEMPERATURE RESISTANT POLYIMIDE FIBERS AND PROCESS FOR PRODUCING THE SAME

[75] Inventors: Claus Schobesberger; Klaus Weinrotter; Herbert Griesser, all of Vöcklabruck; Sigrid Seidl, Seewalchen, all of Austria

[73] Assignee: Lenzing Aktiengesellschaft, Lenzing, Austria

[21] Appl. No.: 763,807

[22] Filed: Sep. 23, 1991

[30] Foreign Application Priority Data

Oct. 15, 1990 [AT] Austria ..... 2077/90

[51] Int. Cl.[6] ..... C08G 73/10; D01F 6/00

[52] U.S. Cl. ..... 528/353; 528/125; 528/126; 528/128; 528/172; 528/173; 528/176; 528/183; 528/188; 528/220; 528/224; 528/229; 528/350; 428/359; 428/364; 428/369; 428/397; 264/168; 264/177.13; 264/177.17; 264/205; 264/211.15; 264/211.17; 264/233; 264/331.16

[58] Field of Search ..... 528/220, 126, 128, 125, 528/173, 172, 224, 229, 350, 183, 353, 188, 176; 428/359, 364, 395, 369; 264/168, 177.13, 177.17, 205, 211.15, 211.17, 233, 331.16

[56] References Cited

U.S. PATENT DOCUMENTS

| | | | |
|---|---|---|---|
| 3,985,934 | 10/1976 | Farrissey, Jr. et al. | 428/397 |
| 4,238,538 | 12/1980 | Manwiller | 528/182 |
| 4,801,502 | 1/1989 | Weinrotter et al. | 428/397 |
| 5,120,814 | 6/1992 | Seidl | 528/350 |

FOREIGN PATENT DOCUMENTS 8900016 9/1989 WIPO .

*Primary Examiner*—John Kight, III
*Assistant Examiner*—P. Hampton-Hightower
*Attorney, Agent, or Firm*—Kenyon & Kenyon

[57] ABSTRACT

There are disclosed flame-retardant, high temperature resistant polyimide fibers of the general formula (I)

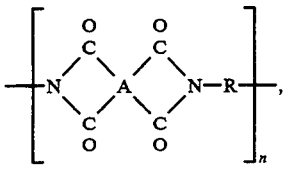

wherein n is an integer larger than 1, A is a tetravalent aromatic group and R is at least one divalent aromatic group. These polyimide fibers have been heat-treated in the unstretched state and have a maximum shrinkage of 14% when heated to a temperature of 400° C. These polyimide fibers are produced by initially spinning crude fibers from a solution of the appropriate polyimide in an aprotic organic solvent, preferably according to the dry-spinning method, which solution optionally contains additives. The crude fibers obtained are washed with water to remove the solvent. The washed crude fibers are dried to a moisture content of less than 5% by mass, are subjected to a heat treatment at a temperature of between 315° C and 450° C, are cooled and, if desired, are crimped and cut to staple fibers. What is essential is that the heated crude fibers are heat-treated and cooled in the unstretched state.

6 Claims, No Drawings

FLAME-RETARDANT, HIGH TEMPERATURE RESISTANT POLYIMIDE FIBERS AND PROCESS FOR PRODUCING THE SAME

The invention relates to flame-retardant, high temperature resistant polyimide fibers as well as to a process for producing the same.

Aromatic polyimide fibers are starting materials for the production of heat-stable tissues much sought after, i.a., due to their pronounced thermostability and their flame retardance. The production of such fibers is known, for instance, from U.S. Pat. No. 3,985,934. The polyimide itself is obtained by reacting benzophenone-3,3',4,4'-tetracarboxylic dianhydride, 4,4'-methylenebis(phenyl isocyanate) and 2,4- or 2,6-toluene diisocyanate); the fibers are produced, in particular, by wet-spinning. Another process for producing aromatic polyimide fibers is known from U.S. Pat. No. 4,801,502. According to that process, crude fibers are at first spun from a solution of the appropriate polyimide in an aprotic organic solvent according to the dry-spinning method, the crude fibers obtained are washed with water to remove the solvent, the washed crude fibers are dried, subjected to a heat treatment at a temperature of between 315° C. and 450° C., are stretched during the heat treatment, subsequently are cooled and, if desired, are crimped and cut to staple fibers.

All the aromatic polyimide fibers commercially available at present have amorphous polymer structures and shrink at heat exposure, the fiber shrinkage increasing with the temperature. The highest shrinkage is developed by polyimide fibers at temperatures of above the glass transition temperature, shrinkages by 40% at a temperature of 320° C. and by 50% at a temperature of 400° C. being observed, as a rule. In PCT-application AT 89/00016 polyimide fibers that have an even higher shrinkage are described.

With various applications, for instance, as insulating mats, conveying belt coats and fire extinguishing blankets, which are exposed to high temperatures having peak values that lie above the glass transition temperature of the polyimide fibers, thermal shrinkages may occur. Thus, further use of the product is no longer possible, or consecutive failures due to modifications of the product cannot be excluded.

It is the object of the invention to widen the field of application of polyimide fibers in this regard and to provide flame-retardant, high temperature resistant polyimide fibers that exhibit a low thermal shrinkage even at elevated temperatures.

This object is achieved by polyimide fibers of the general formula

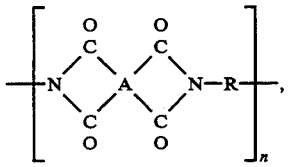

(I)

wherein n is an integer larger than 1, A is a tetravalent aromatic group selected from

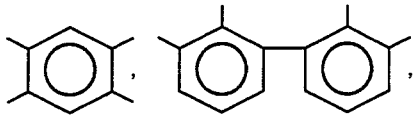

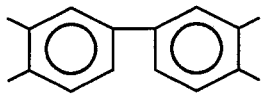

and

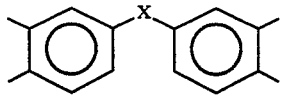

wherein X represents CO, $CH_2$, O, S, $CF_2$ and R is at least one of the following divalent aromatic groups selected from

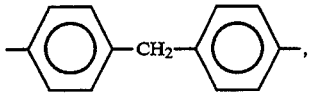

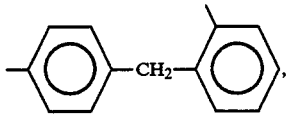

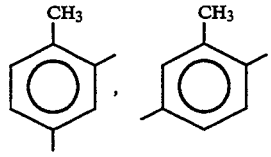

and

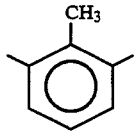

which polyimide fibers have been heat-treated in the unstretched state and have a maximum shrinkage of 14% when heated to a temperature of 400° C.

A preferred embodiment of the polyimide fibers according to the invention is characterized in that the polyimide fibers contain additives, preferably coloring agents, soot, polytetrafluoroethylene or mica.

The polyimide fibers according to the invention can be produced by modifying the process described in U.S. Pat. No. 4,801,502, by initially spinning crude fibers from a solution of the appropriate polyimide in an aprotic organic solvent, preferably according to the dry-spinning method, which solution optionally contains additives, the crude fibers obtained are washed with water to remove the solvent, the washed crude fibers are dried to a moisture of less than 5% by mass, are subjected to a heat treatment at a temperature of between 315° C. and 450° C., are cooled and, if desired, are crimped and cut to staple fibers, wherein the process of the invention is characterized in that the crude fibers are heat-treated and cooled in the unstretched state. Washing out of the solvent is effected at a temperature of between 80° and 100° C., drying is effected at 120° to 300° C.

A preferred variant of this process is characterized in that the crude fibers are allowed to shrink ("relax") during the heat treatment up to 20% of their lengths, preferably by between 15 and 20%. The polyimide fibers produced in this manner not only exhibit a slight thermal shrinkage, but also have a high strength. This is surprising, since with chemical fibers high-temperature stretching and not high-temperature shrinking usually is applied in order to increase the strength of fibers.

In order to obtain the fibers in an unstretched state during the heat treatment or to allow for a shrinkage of the same, it has proved suitable to supply the washed crude fibers to an installation comprising a drier and a heating means, at a speed of between 2 and 20 m/min and to withdraw them from this installation at a speed of between 1.6 and 20 m/min, the crude fibers being heated in the heating means, preferably to a temperature of between 330° C. and 390° C. The drier may be designed as a perforated cylinder drier or a calender drier. Heated rolls, heating tables or hot-air stoves have proved as particularly successful heating means. The heat treatment may be effected in one or several stages.

The washed crude fibers may be pre-heated with a commercially available antistatic agent before drying and finished after the heat treatment in a known manner.

When heated up to 250° C., the polyimide fibers according to the invention exhibit a thermal shrinkage of less than 1% of their length. Up to 280° C., they maximally shrink by 2%, and up to 320° C. their maximum shrinkage is 10%. Furthermore, the fibers exhibit an excellent thermostability and withstand a temperature load of up to 310° C. over a long duration. In addition, they are extendible by between 70 and 160% such that they are applicable on an extremely wide scale. Their LOI (limiting oxygen index) value according to ASTM D-2863 amounts to more than 36% $O_2$. The fibers are infusible; their point of decomposition lies above 450°C.

The following examples are intended to illustrate the invention in even more detail. The production of the crude fibers may be effected both according to the wet-spinning method and according to the dry-spinning method. The crude fibers described in the examples were dry-spun.

Production of crude fibers

The production of the crude fibers may be effected according to the dry-spinning method described in U.S. Pat. No. 4,801,502. To this end, the polyimide of the general formula (I), in which R partially is a 4,4'-bisphenylmethylene group and partially represents a 2,4- and 2,6-toluene group, is dissolved in dimethylformamide. Subsequently, the mixture is converted into a spinning solution by heating to 60° C., is degassed by applying a negative pressure, is filtered and supplied to the spinning head of a dry-spinning tower via a gear pump. Spinning is effected via a perforated spinneret; the shape of the orifices is circular. The spinning stock ("crude fiber") is collected on bobbins. In this manner, crude fibers having different titers can be produced.

Example 1

A filament fiber bundle produced according to the dry-spinning method and having a single filament titer of 1.4 dtex was washed with water at 97° C. pre-heated, subsequently guided over a perforated cylinder drier at 210° C. and 20 m/min and dried to a residual moisture of less than 1%. After this, the as-spun tow was guided over a heating roll, heated to 330° C., taken up at 16 m/min, crimped and cut to staple fibers.

| at the heating roll Data of the fiber obtained: | |
|---|---|
| Shrinkage | 20% |
| Titer | 1.75 dtex |
| Tensile strength | 19–22 cN/tex |
| Elongation | 140–160% |
| Thermal shrinkage at | |
| 250° C. | <1% |
| 280° C. | 0.4–1.0% |
| 320° C. | 3.0–5.2% |
| 400° C. | 6.9–8.8% |
| Limiting oxygen index | 36–38% $O_2$ |

Example 2

A filament fiber bundle produced according to the dry-spinning method and having a single filament titer of 2.2 dtex was washed with water at 96° C., pre-heated, subsequently guided over a perforated cylinder drier at 120° C. and 2 m/min and dried to a residual moisture of less than 1%. After this, the as-spun tow was guided over a heating roll, heated to 315° C., taken up, at 2 m/min crimped and cut to staple fibers.

| at the heating roll Data of the fiber obtained: | |
|---|---|
| Shrinkage | 0% |
| Titer | 1.1 dtex |
| Tensile strength | 15–19 cN/tex |
| Elongation | 90–110% |
| Thermal shrinkage at | |
| 250° C. | <1% |
| 280° C. | 0.3–1.5% |
| 320° C. | 6.6–8.1% |
| 400° C. | 10.2–12.1% |
| Limiting oxygen index | 36–38% $O_2$ |

Example 3

A filament fiber bundle produced according to the dry-spinning method and having a single filament titer of 6.6 dtex was washed with water at 80° C., pre-heated, subsequently guided over a perforated cylinder drier at 300° C. and 10 m/min and dried to a residual moisture of less than 1%. After this, the as-spun tow was guided over a heating roll, heated to 390° C., taken up at 8 m/min, crimped and cut to staple fibers.

| at the heating roll Data of the fiber obtained: | |
|---|---|
| Shrinkage | 20% |
| Titer | 5.3 dtex |
| Tensile strength | 19–21 cN/tex |
| Elongation | 110–130% |
| Thermal shrinkage at | |
| 250° C. | <1% |
| 280° C. | 0.4–0.9% |
| 320° C. | 2.9–4.5% |
| 400° C. | 6.0–8.4% |
| Limiting oxygen index | 36–38% $O_2$ |

Example 4

A filament fiber bundle produced according to the dry-spinning method and having a single filament titer of 10.6 dtex was washed with water at 98° C., pre-heated, subsequently guided over a perforated cylinder drier at 80° C. and 15 m/min and dried to a residual moisture of less than 1%. After this, the as-spun tow was guided over a heating roll, heated to 350° C., taken up at 12 m/min, crimped and cut to staple fibers.

| at the heating roll Data of the fiber obtained: | |
|---|---|
| Shrinkage | 20% |
| Titer | 8.5 dtex |
| Tensile strength | 20–22 cN/tex |
| Elongation | 110–140% |
| Thermal shrinkage at | |
| 250° C. | <1% |
| 280° C. | 0.8–1.1% |
| 320° C. | 3.1–5.3% |
| 400° C. | 6.2–8.8% |
| Limiting oxygen index | 36–38% $O_2$ |

Example 5

A filament fiber bundle produced according to the dry-spinning method and having a single filament titer of 5.8 dtex was washed with water at 95° C. pre-heated, sized subsequently guided over a perforated cylinder drier at 170° C. and 20 m/min and dried to a residual moisture of less than 1%. After this, the as-spun tow was guided over a heating roll heated to 450° C., taken up at 17 m/min and bobbined.

| at the heating roll Data of the fiber obtained: | |
|---|---|
| Shrinkage | 15% |
| Titer | 5.0 dtex |
| Tensile strength | 18–20 cN/tex |
| Elongation | 100–110% |
| Thermal shrinkage at | |
| 250° C. | <1% |
| 280° C. | 0.6–1.0% |
| 320° C. | 3.1–4.2% |
| 400° C. | 6.0–7.8% |
| Limiting oxygen index | 36–38% $O_2$ |

Example 6

A filament fiber bundle produced according to the dry-spinning method and having a single filament titer of 2.2 dtex was washed with water at 80° C., pre-heated, subsequently guided over a perforated cylinder drier at 210° C. and 15 m/min and dried to a residual moisture of less than 1%. After this, the as-spun tow was guided over a heating roll heated to 400° C., taken up at 13 m/min and bobbined.

| at the heating roll Data of the fiber obtained: | |
|---|---|
| Shrinkage | 15% |
| Titer | 2.5 dtex |
| Tensile strength | 18–20 cN/tex |
| Elongation | 100–130% |
| Thermal shrinkage at | |
| 250° C. | <1% |
| 280° C. | 0.6–1.1% |
| 320° C. | 3.2–5.0% |
| 400° C. | 6.4–9.0% |
| Limiting oxygen index | 36–38% $O_2$ |

What we claim is:

1. The product of the process for producing flame-retardant, high temperature resistant polyimide fibers of the general formula

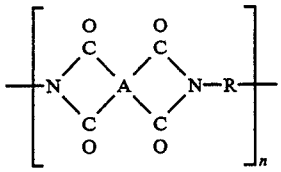

wherein n is an integer larger than 1, A is a tetravalent aromatic group selected from

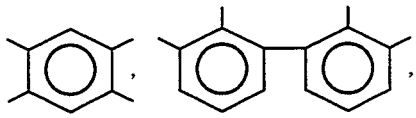

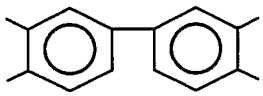

or

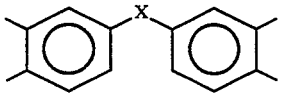

wherein X represents CO, $CH_2$, O, S, $CF_2$ and R is at least one of the following divalent aromatic groups selected from the group consisting of

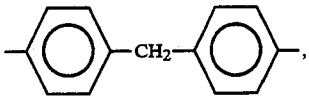

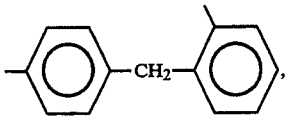

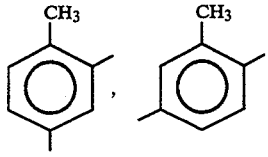

and

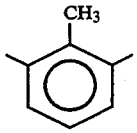

which process comprises preparing a solution of an appropriate polyimide in an aprotic organic solvent, spinning said solution so as to obtain crude fibers, washing said crude fibers with water to remove solvent and obtain washed crude fibers, drying said washed crude fibers to a moisture content of less than 5% by mass so as to obtain dried crude fibers, subjecting said dried crude fibers to a heat-treatment at a temperature ranging between 315° C. and 450° C. so as to obtain heat-treated crude fibers, and cooling said heat-treated crude fibers, the improvement wherein subjecting of said dried crude fibers to a heat-treatment and cooling of said heat-treated crude fibers are effected in the unstretched state of said crude fibers.

2. Flame-retardant, high temperature resistant polyimide fibers of the general formula

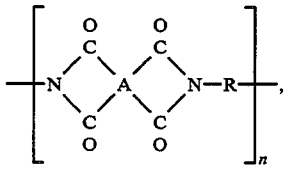

(I)

wherein n is an integer larger than 1, A is a tetravalent aromatic group selected from

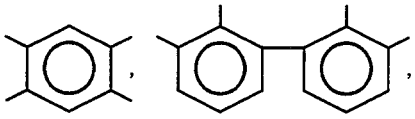

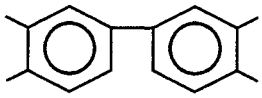

or

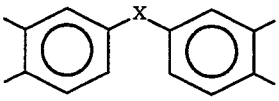

wherein X represents CO, $CH_2$, O, S, $CF_2$ and R is at least one of the following divalent aromatic groups selected from the group consisting of

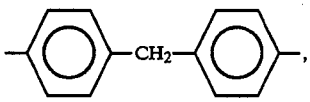

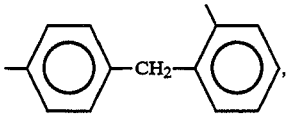

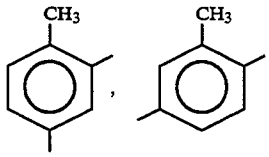

and

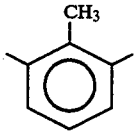

which polyimide fibers have been heat-treated in the unstretched state and have a maximum shrinkage of 14% when heated to a temperature of 400° C.

3. Polyimide fibers as set forth in claim 2, further comprising additives.

4. Polyimide fibers as set forth in claim 3, wherein said additives are selected from the group consisting of coloring agents, soot, polytetrafluoroethylene and mica.

5. A polyimide fiber according to claim 2 that shrinks less than about 12.1% when heated to 400° C.

6. A polyimide fiber according to claim 2 that shrinks less than about 9% when heated to 400° C.

* * * * *

UNITED STATES PATENT AND TRADEMARK OFFICE

CERTIFICATE OF CORRECTION

PATENT NO. : 5,384,390

DATED : January 24, 1995

INVENTOR(S) : Claus Schoebesberger et al

It is certified that error appears in the above-indentified patent and that said Letters Patent is hereby corrected as shown below:

| Column | Line | |
|---|---|---|
| 4 | 8-10 | Delete entirely and insert the following: --Shrinkage at the heating roll 20% Data of the fiber obtained:--. |
| 4 | 28 | After "up" delete --,--. |
| 4 | 29 | After "m/min" insert --,--. |
| 4 | 31-33 | Delete entirely and insert the following: --Shrinkage at the heating roll 0% Data of the fiber obtained:--. |
| 4 | 53-55 | Delete entirely and insert the following: --Shrinkage at the heating roll 20% Data of the fiber obtained:-- |

UNITED STATES PATENT AND TRADEMARK OFFICE

CERTIFICATE OF CORRECTION

PATENT NO. : 5,384,390

DATED : January 24, 1995

INVENTOR(S) : Claus Schoebesberger et al

It is certified that error appears in the above-indentified patent and that said Letters Patent is hereby corrected as shown below:

| Column | Line | |
|---|---|---|
| 5 | 8-10 | Delete entirely and insert the following: --Shrinkage at the heating roll 20% Data of the fiber obtained:--. |
| 5 | 31-33 | Delete entirely and insert the following: --Shrinkage at the heating roll 15% Data of the fiber obtained:--. |
| 5 | 53-55 | Delete entirely and insert the following: --Shrinkage at the heating roll 15% Data of the fiber obtained:-- |

Signed and Sealed this

Thirtieth Day of May, 1995

*Attest:*

Bruce Lehman

BRUCE LEHMAN

*Attesting Officer*

*Commissioner of Patents and Trademarks*